US006082791A

United States Patent [19]

Frolov et al.

[11] Patent Number: 6,082,791

[45] Date of Patent: Jul. 4, 2000

[54] ELECTRIC STRIKE

[75] Inventors: George Frolov, Farmington; Ryan Cutter, Kensington, both of Conn.

[73] Assignee: Harrow Products, Inc., Grand Rapids, Mich.

[21] Appl. No.: 09/007,667

[22] Filed: Jan. 15, 1998

[51] Int. Cl.[7] ..... E05B 15/02

[52] U.S. Cl. ..... 292/341.16; 292/201

[58] Field of Search ..... 292/341.15, 341.16, 292/341.17, 201; 70/432, 441, 443

[56] References Cited

U.S. PATENT DOCUMENTS

| | | | |
|---|---|---|---|
| 1,161,158 | 11/1915 | Rennert | 70/432 |
| 3,819,215 | 6/1974 | Fuss | 292/201 |
| 4,015,869 | 4/1977 | Horvath | 292/341.16 |
| 4,170,374 | 10/1979 | Garcia | 292/201 |
| 4,756,566 | 7/1988 | Logas | 292/341.16 |
| 5,118,150 | 6/1992 | Jarrett | 292/341.16 |
| 5,490,699 | 2/1996 | Uyeda | 292/341.16 |

*Primary Examiner*—Steven Meyers
*Assistant Examiner*—John B. Walsh
*Attorney, Agent, or Firm*—Alix, Yale & Ristas, LLP

[57] ABSTRACT

An electrically controlled strike has a strike frame defining a jamb face opening and a strike face opening. A keeper assembly selectively closes across the frame face opening. A lock assembly readily reconfigurable between fail secure and fail safe arrangements locks the keeper in the closed position. The actuator of the lock assembly drives a plunger between first and second positions to lock and unlock the keeper assembly. The plunger is biased to the first position. A lock member is mountable to the plunger in the fail safe configuration wherein the keeper is released when the plunger is in the second position. The locking member is also engageable to the plunger in a fail secure arrangement wherein the keeper is locked when the plunger is in the first position and the keeper is released when the plunger is in the second position. The strike also incorporates a jamming resistant feature for both the fail safe and fail secure configurations.

18 Claims, 7 Drawing Sheets

ELECTRIC STRIKE

BACKGROUND OF THE INVENTION

This invention relates to the field of door security systems. More specifically, this invention relates to an electric strike for securing a door to a door frame.

Electric strikes for securing hinged or swinging doors having projectable dead bolts or latch bolts are well-known in the field of door security systems. The electric strike can be employed alone or in combination with other conventional security systems to secure the door. The electric strike is mounted to the door frame and defines an opening in the jamb face of the door frame for reception of a bolt from a lock set such as dead bolt and/or a latch bolt. The electric strike further defines an opening in the frame face contiguous with the opening in the jamb face of the door frame.

A pivotable keeper on the electric strike selectively closes the opening in the frame face. The bolt projecting from the edge of the door engages the electric strike through the opening in the jamb face. Actuation of the electric strike unlocks the keeper to allow the door to open. The door can be therefore pushed whereby the bolt engages the strike. The keeper pivots to uncover or open the frame face opening and allow the bolt to swing therethrough and thereby allow opening of the door.

The lock assembly of a conventional electric strike is commonly operated by a solenoid. The lock assembly of an electric strike can typically be configured in either a fail safe or fail secure arrangement. In a fail safe configuration, the electric strike is automatically unlocked to allow egress through the doorway in an emergency situation, in particular, when electrical current is interrupted to the electric strike. Alternatively, in circumstances requiring increased levels of security, the lock assembly can be configured such that if electrical current is interrupted to the electric strike, the electric strike is automatically maintained in a locked arrangement.

In some prior electric strikes, the electric strike is initially permanently constructed in either a fail safe or fail secure arrangement and cannot be readily reconfigured. Therefore, two different electric strike models must be manufactured and inventoried resulting in increased costs and inefficiencies. Other prior electric strikes have required substantial modification in order to reconfigure them between a fail secure or fail safe arrangements. For example, the entire solenoid must be replaced with an opposite acting solenoid in order to reconfigure the electric strike between the fail safe and fail secure arrangement for some conventional electric strikes.

Installation costs can be significantly increased by the additional time and additional components required in order to specifically configure each electric strike for a particular security arrangement. Furthermore, if at a later time reconfiguration is required, either substantial modification to the electric strike or replacement of the entire electric strike may be required in order to change the electric strike from or to a fail safe or a fail secure configuration.

SUMMARY OF THE INVENTION

Briefly stated, the electric strike in a preferred form has a strike frame defining a jamb face opening and a frame face opening contiguous with the jamb face opening. A keeper assembly having a keeper is pivotally mounted to the strike frame. The keeper opens and closes the frame face opening to allow dead bolts and/or latch bolts to swing through the frame face opening and thereby allow selective access through a doorway.

The keeper assembly is locked in the closed position by a lock assembly which engages the keeper assembly. The lock assembly is operated by a solenoid having a displaceable plunger. The lock assembly further has a multiple pivot locking member for engaging the keeper assembly. The locking member supports a mount pivot pin pivotably engageable to a locking member mount on the strike frame. The locking member further supports a pivot pin which is pivotally engageable to the solenoid plunger. Actuation of the solenoid plunger pivotally moves the locking member to thereby lock or unlock the keeper assembly. The locking member mount and plunger solenoid together define multiple mounting positions for the locking member. The locking member can be mounted to the locking member mount and plunger solenoid in either a fail safe or fail secure arrangement. The locking member can be efficiently repositioned at any of the multiple mounting positions.

In the preferred embodiment of the electric strike, the locking member mount defines first and second mount openings and the solenoid plunger defines first and second pivot notches. Positioning the locking member so that the mount pivot pin and plunger pivot pin engage the first mount opening and first pivot notch configures the electric strike for fail secure operation. Positioning the locking member so that the mounted plunger pivot pins engage the second mount opening and the second pivot notch configures the electric strike for fail safe operation. The locking member can be readily removed and repositioned on the plunger and locking member mount to allow rapid efficient transformation of the strike between a fail safe and fail secure configurations without requiring specialized tools or additional strike components.

An object of the invention is to provide a new and improved electric strike for selectively controlling access through a doorway.

Another object of the invention is to provide an electric strike which is readily transformable between fail safe and fail secure configurations.

A further object of the invention is to provide an electric strike which has an efficient low cost construction and can be transformed to either a fail safe or fail secure mode without replacing the solenoid actuator.

A yet further object of the invention is to provide an electric strike which is resistant to jamming resulting from side loading of the strike regardless of whether the strike is configured for a fail safe or fail secure function.

These and other objects of the invention will become apparent from a review of the specification and the drawings.

DETAILED DESCRIPTION OF THE PREFERRED EMBODIMENTS

Figure 16:
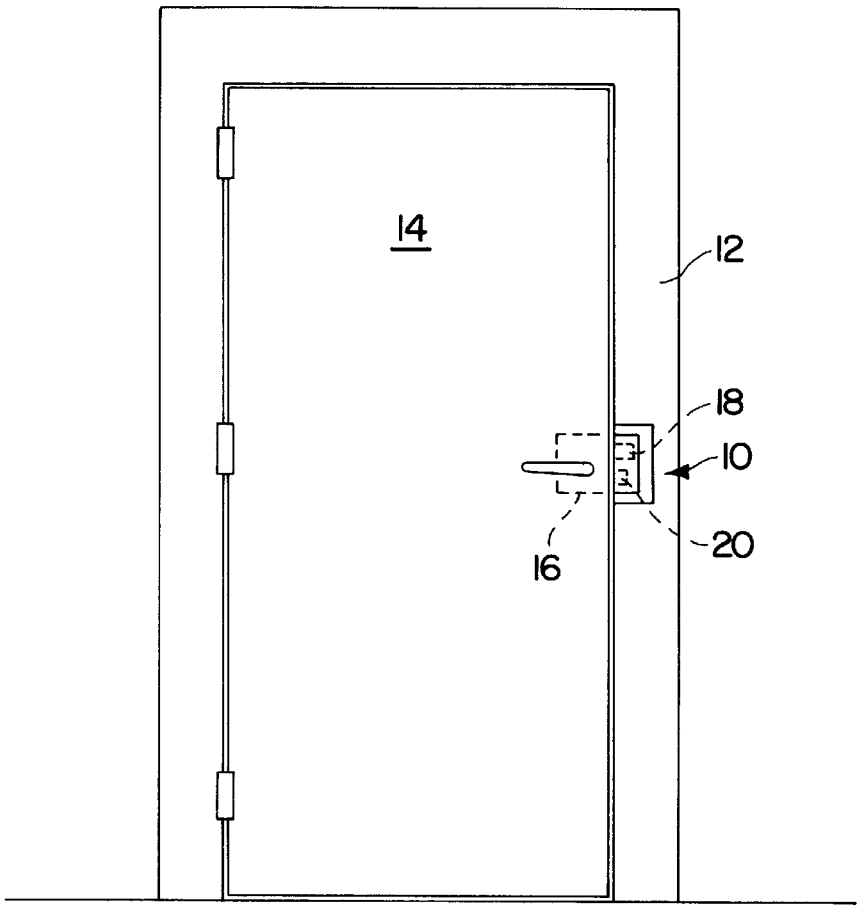
FIG. 16 is a front view of the electric strike of FIG. 1 in combination with a door having a lock set and a supporting door frame illustrated in phantom.
Figure 17:
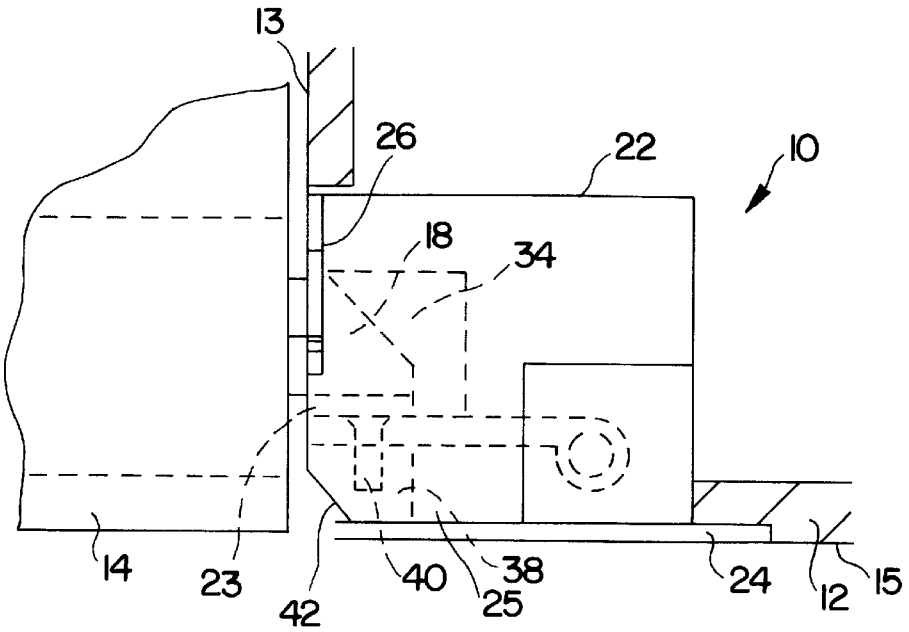
FIG. 17 is a fragmentary top view, partially in phantom, of the electric strike, door and frame of FIG. 16.

With reference to FIGS. 16–17, an electric strike in accordance with the invention is designated generally by the numeral 10. The electric strike 10 selectively secures a door 14 to a door frame 12 to provide controlled access through the doorway. The electric strike 10 selectively functions in a dual mode capacity to provide either a fail safe or fail secure locking feature.

The electric strike 10 is mounted to the vertical edge of the door frame 12. The electric strike 10 can preferably without modification be readily mounted to either vertical side of the door frame 12 for either right or left opening doors. The door 14 has conventional hardware including a latch set 16 having a latch bolt 18 and a dead bolt 20 extending therefrom for engagement with the electric strike 10. The electric strike 10 is positioned in a cut out through the frame face 15 and jamb face 13 on the corner of the door frame 12.

Figure 1:
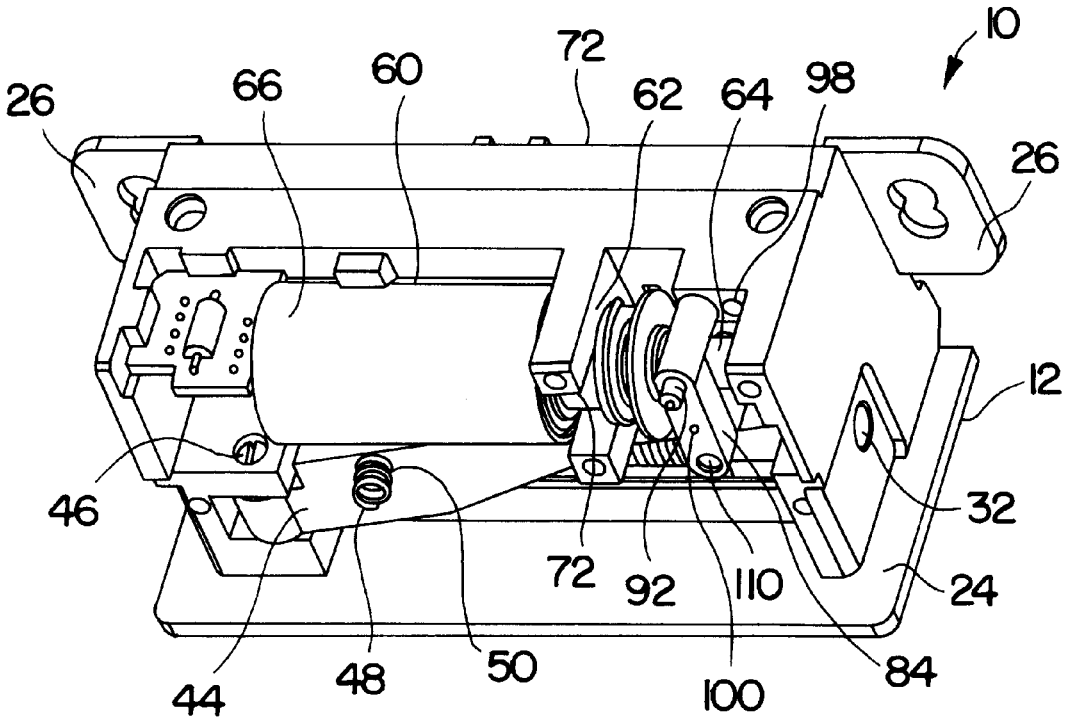
FIG. 1 is a rear perspective view of the electric strike of the invention without housing covers.
Figure 2:
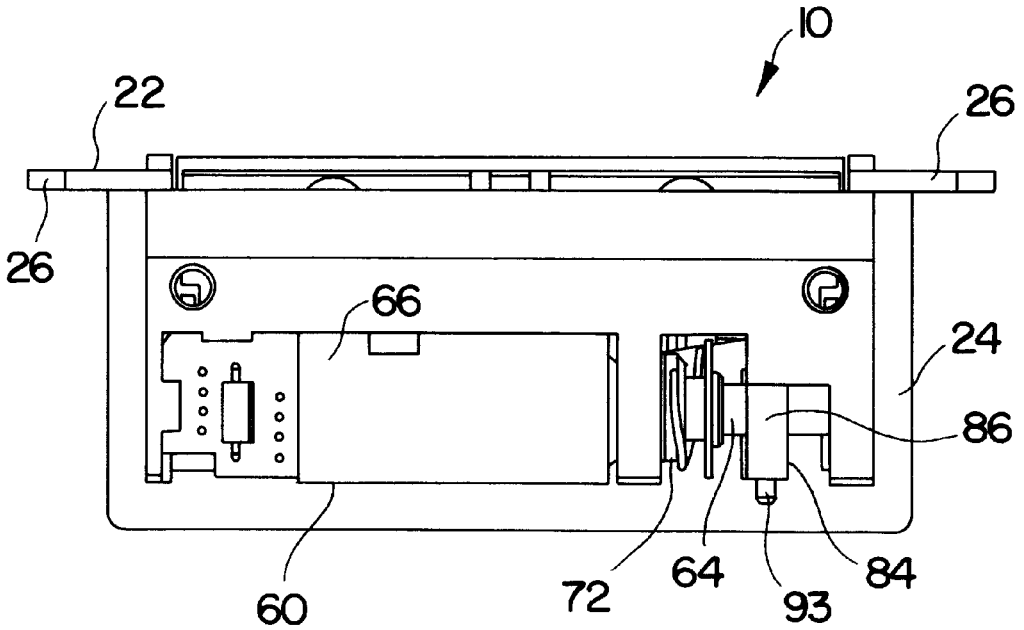
FIG. 2 is a top plan view of the electric strike of FIG. 1.
Figure 3:
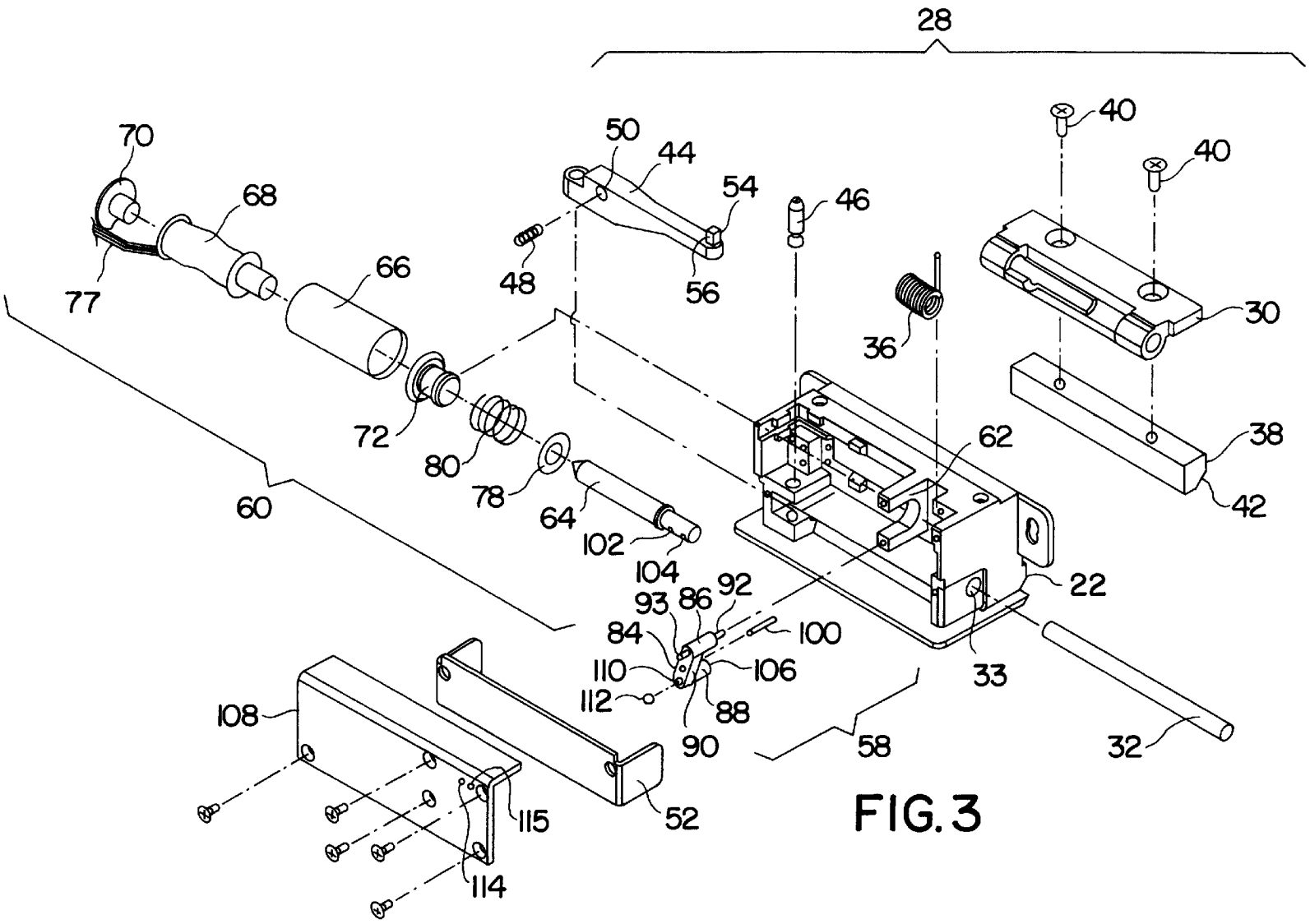
FIG. 3 is an exploded rear perspective view of the electric strike of FIG. 1 including housing covers and a solenoid housing.

With additional reference to FIGS. 1–3, the electric strike 10 has a strike frame 22. The strike frame 22 defines a jamb face opening 23 oriented toward the door 14 and generally coplanar with the jamb face 13 of the door frame 12. The strike frame 22 further defines a frame face opening 25 generally orthogonal to the jamb face opening 23 and coplanar with the frame face 15 of the door frame 12. The jamb face opening 23 and frame face opening 25 are contiguous to form a lock cavity whereby the bolts 18, 20 can swing therethrough to allow opening of the door 14. The strike frame 22 has a laterally and longitudinally extending frame face flange 24 for extension along the frame face of the door frame 12. The strike frame 22 further has a pair of opposed longitudinally extending coplanar mounting tabs 26 for receiving fasteners (not shown) to mount the electric strike 10 to the jamb face 13 of the door frame 12.

A keeper assembly 28 is mounted to the strike frame 22. The keeper assembly has a keeper 30 pivotally mounted to the strike frame 22 by a longitudinally oriented keeper pin 32. The strike frame 22 defines a keeper pin opening 33 for receiving the keeper pin 32. The keeper assembly 28 selectively closes across the frame face opening 25. The keeper 30 in the closed position and strike frame 22 together define a bolt receiving cavity 34 for receiving the bolts 18, 20 of the latch set 16. The keeper 30 is pivotable between the closed position across the frame face opening 25 and an opened position whereby the bolts 18, 20 can swing through the frame face opening 25. The keeper 30 is biased to the closed position by a torsion keeper spring 36 surrounding the keeper pin 36. The keeper spring 36 has a first end engaged with the keeper 30 and an opposite second end engaged with the strike frame 22.

A longitudinally oriented keeper face member 38 is mounted by screws 40 to the keeper 30. The keeper face member 38 defines a beveled face 42 for engaging the beveled latch bolt 18. The bevel of the latch bolt 18 engages the beveled face 42 as the door 14 closes to thereby drive the latch bolt 18 inward and allow full closure of the door 14 when the keeper 30 is in the closed position.

The keeper assembly 28 has a retaining arm 44. The retaining arm 44 is pivotally mounted to the strike frame 22 and is in camming engagement with the keeper 30. A retaining arm pin 46 threadably engages the strike frame 22 to support the retaining arm 44 onto the strike frame 22. The retaining arm 44 has an axis of rotation generally orthogonal to the axis of rotation of the keeper 30 and is positioned longitudinally in the strike frame 22 generally parallel to the keeper 30.

A compression retaining arm spring 48 engages a spring opening 50 in the retaining arm 44 and biases the retaining arm 44 against the keeper 30. The retaining arm spring 48 is maintained in compression between the retaining arm 44 and a lower housing cover 52. The lower housing cover 52 forms a rear plate against which the retaining arm spring 48 engages. The lower housing cover 52 further has transversely extending panels that cover the ends of the keeper pin opening 33 into which the keeper pin 32 is inserted, thereby maintaining the keeper pin 32 in position. The distal end portion of the retaining arm 44 supports an orthogonally oriented locking pin 54. The locking pin 54 defines an arm engagement surface 56 for engagement by a lock assembly 58.

In operation, the keeper 30 is biased to the closed position by the keeper spring 36. The retaining arm 44 is maintained in a first position against the keeper 30 by the retaining arm spring 48. A door user pushes on the door 14 such that the bolts 18, 20 engage the keeper 30 and drive the keeper 30 to the opened position. The camming engagement of the keeper 30 and the retaining arm 44 results in pivoting the retaining arm 44 outward against the biasing force of the retaining arm spring 48 when the keeper moves from the closed to the opened position. The retaining arm 44 is thereby in a second position when the keeper 30 is in the opened position. The keeper 30 is returned to the closed position by the biasing force of the keeper spring 36 once the bolts 18, 20 have cleared the keeper 30. The retaining arm 44 is then returned from the second position to the first position under the biasing force of the retaining arm spring 48.

The lock assembly 58 engages the locking pin 54 on the retaining arm 44 to lock the retaining arm 44 in the first position. Locking the retaining arm 44 in the first position locks the keeper 30 in the closed position due to the camming engagement of the retaining arm 44 and the keeper 30. The lock assembly 58 is controlled by an electrically powered solenoid 60. The solenoid 60 is mounted longitudinally in the electric strike 10 by a support cradle 62 defined in the strike frame 22. The solenoid 60 includes a solenoid housing 66 containing a solenoid coil 68. The solenoid 60 has a longitudinally movable solenoid plunger 64 mounted within the solenoid coil 68. The solenoid coil 68 is maintained in a position by first and second solenoid end portions 70, 72. The solenoid is controlled and energized over conducting cables 77. The second end portion 72 is captured in the cradle 62 of the strike frame 22.

The plunger 64 is longitudinally movable within the coil 68 between an extended position and a retracted position. The extended position of the plunger 64 is defined by a stop 82 on the strike frame 22. The retracted position of the plunger is defined by a solenoid washer 78 engaged to a shoulder on the plunger 64 and contacting the solenoid second end portion 72. A solenoid spring 80 is positioned between the solenoid washer 78 and the support cradle 62 to bias the plunger 64 to the projected position against the stop 82.

The selective dual function capability is provided by a pivoting locking member 84 which provides a dual position coupling as described below. The locking member 84 pivotally engages the plunger 64 by means of a plunger pivot pin 100 of the locking member 84. The locking member 84 has a generally U-shaped configuration with a pivoting arm 86 and a spaced parallel engagement arm 88 interconnected by a base portion 90. The pivoting arm 86 defines a through bore 87 for receiving a mount pivot pin 92 which extends into a locking member mount 94 defined by the strike frame 22.

Figure 19:
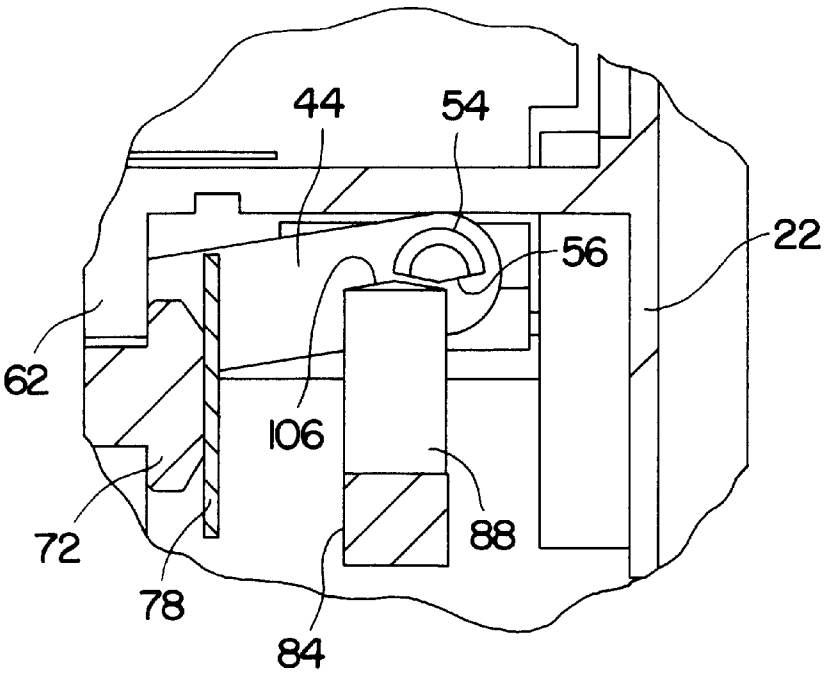
FIG. 19 is an enlarged fragmentary cut away top view of the electric strike of FIG. 6.
Figure 18:
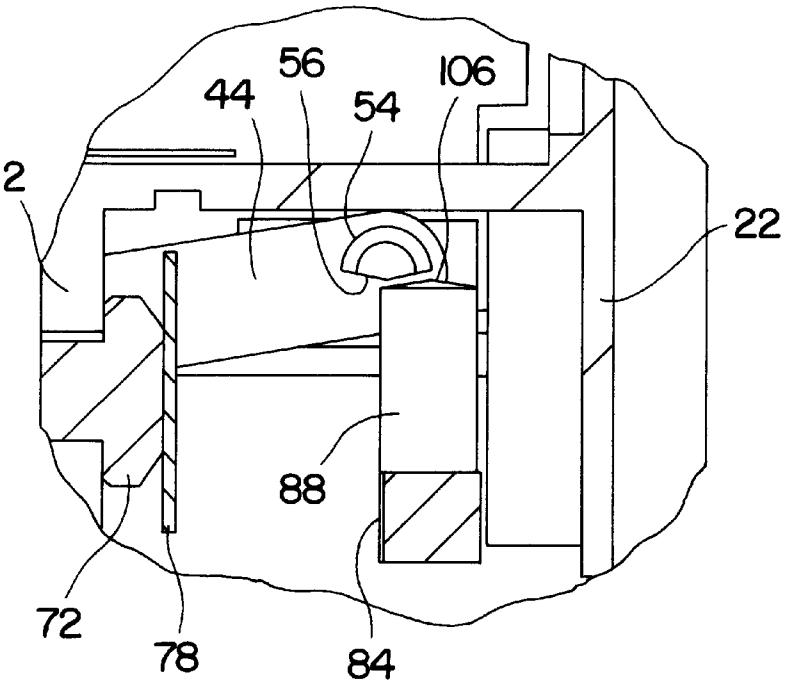
FIG. 18 is an enlarged fragmentary cut away top view of the electric strike of FIG. 5.

In the preferred form, the locking member mount 94 defines longitudinally spaced first and second mount openings 96 and 98 for receiving the mount pivot pin 92. The mount pivot pin 92 is pivotably engageable with either the first or second mount openings 96, 98. The plunger pivot pin 100 extends from the base portion 90 of the locking member 84 and is oriented generally parallel to the mount pivot pin 92. The plunger 64 preferably defines a pair of longitudinally spaced first and second pivot notches 102, 104 for receiving the plunger pivot pin 100. With reference to FIGS. 18 and 19, the end portion of the engagement arm 88 of the locking member 84 defines a lock engagement surface 106 for engagement to the arm engagement surface 56 of the locking pin 54.

The lock assembly 58 operates to lock the keeper assembly 28 in the closed position. More particularly, the solenoid 60 pivots the locking member 84 via the plunger pivot pin 100 on the mount pivot pin 92 whereby the lock engagement surface 106 is positioned to be engaged to the arm engagement surface 56 of the lock pin 54 when the retaining arm 44 is in the first position. The engagement of the lock assembly 58 with the lock pin 54 prevents the retaining arm 44 from pivoting to the second position. The camming relationship between the retaining arm 44 and keeper 30 is configured such that when the retaining arm 44 is maintained in the first position, the keeper 30 cannot be rotated from the closed to the opened position, and the keeper assembly 28 is accordingly locked.

The locking member 84 is maintained in transverse position by an upper housing cover 108 mounted to the strike frame 22. The locking member 84 further preferably defines a spherical indent 110 to support a ball bearing 112 opposite the engagement surface 106. The ball bearing 112 rollingly engages the inside surface of the upper housing cover 108 to allow smooth pivoting motion of the locking member 84. The mount pivot pin 92 has a reduced end portion 93 engageable in a pair of first and second indicator openings 114, 115 defined by the upper housing cover 108. The first and second indicator openings 114, 115 are aligned with the first and second mount openings 96, 98, respectively, whereby the end portion 93 of the mount pivot pin 92 provides a visual indication through the cover 108 of the position of the mount pivot pin 92. The configuration of the locking member 84 in either the fail safe or the fail secure configuration can therefore be determined without removal of the upper housing cover 108.

Figure 6:
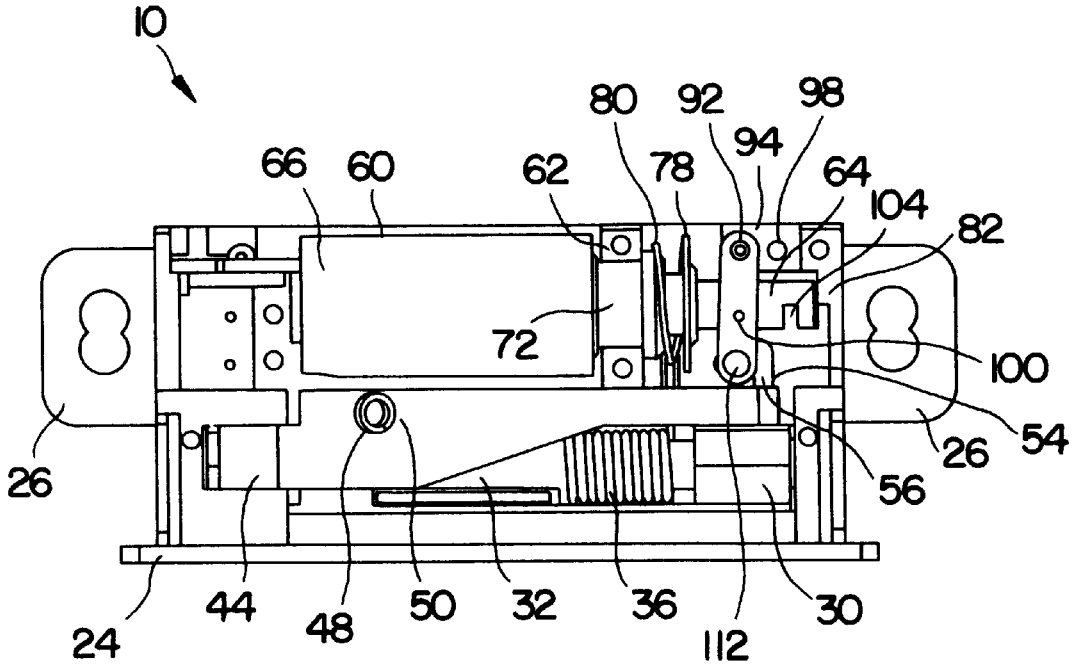
FIG. 6 is a side elevational view of the electric strike of FIG. 1 including the solenoid housing and wherein the electric strike is in the fail secure configuration with the solenoid de-energized.
Figure 7:
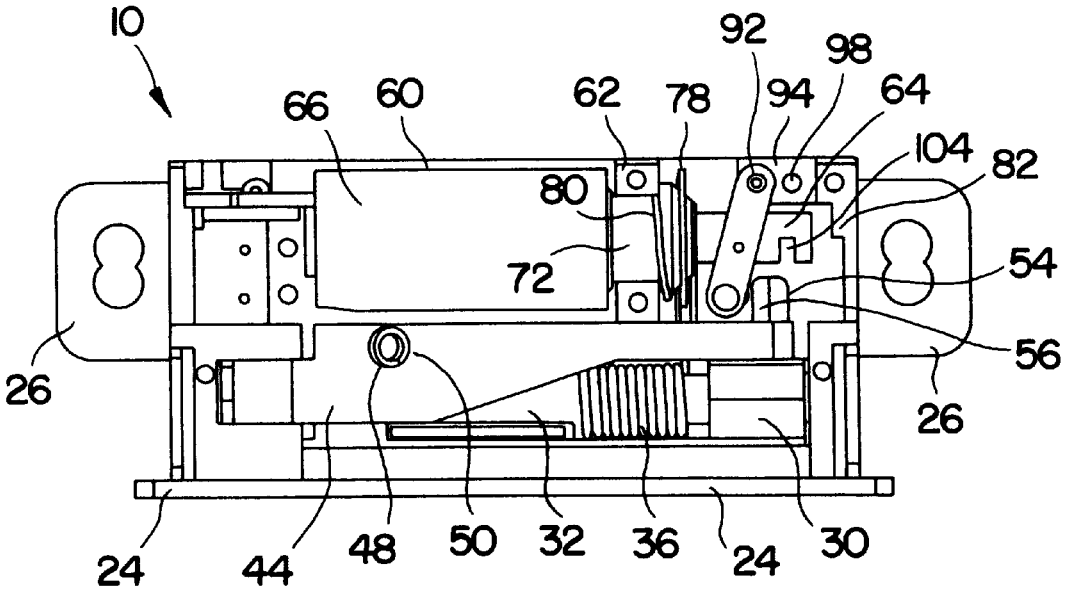
FIG. 7 is the electric strike view of FIG. 6 wherein the solenoid is energized.

With reference to FIGS. 6, 7 and 19 illustrating the fail secure configuration, the mount pivot pin 92 is positioned in the first mount opening 96 and the plunger pivot pin 100 is positioned in the first pivot notch 102 of the plunger 64. In this arrangement with the solenoid 60 de-energized, the engagement arm 88 is positioned whereby the lock engagement surface 106 is engaged to the arm engagement surface 56 of the locking pin 54. Therefore, the retaining arm 44 cannot be pivoted (see FIG. 6) and the keeper assembly 28 is in a locked state without any application of electrical energy to the solenoid 60. The keeper assembly 28 is unlocked by energizing the solenoid 60. The energization of the solenoid 60 retracts the plunger 64 overcoming the biasing force of the solenoid spring 80. The longitudinal motion of the plunger 64 from the extended to the retracted position pivots the locking member 84 on the mount pivot pin 92. The pivoting of the locking member 84 swings the engagement arm 88 of the locking member 84 to a position wherein the lock engagement surface 106 is disengaged from the arm engagement surface 56 of the retaining arm 44. The retaining arm 44 can, as a result of the disengagement of the surfaces 56, 106, be pivoted to the second position by the keeper 30. Therefore, application of an opening force to the door 14 results in the bolts 18, 20 engaging the keeper 30 and pivoting the keeper 30 to the opened position.

Figure 4:
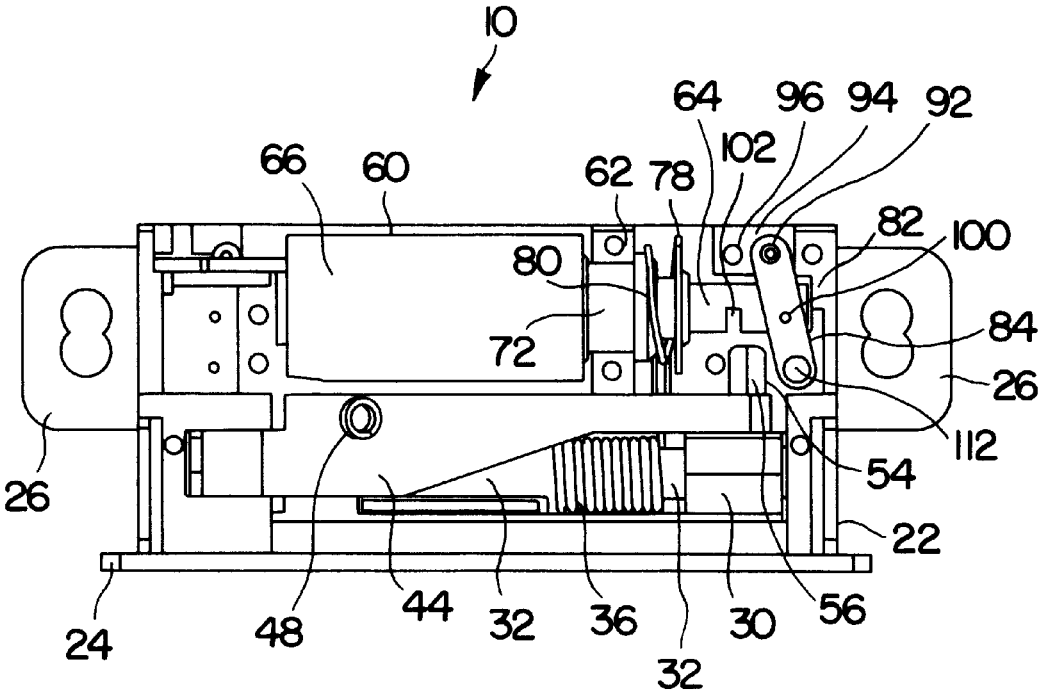
FIG. 4 is a side elevational view of the electric strike of FIG. 1 in a fail safe configuration with the solenoid de-energized.
Figure 5:
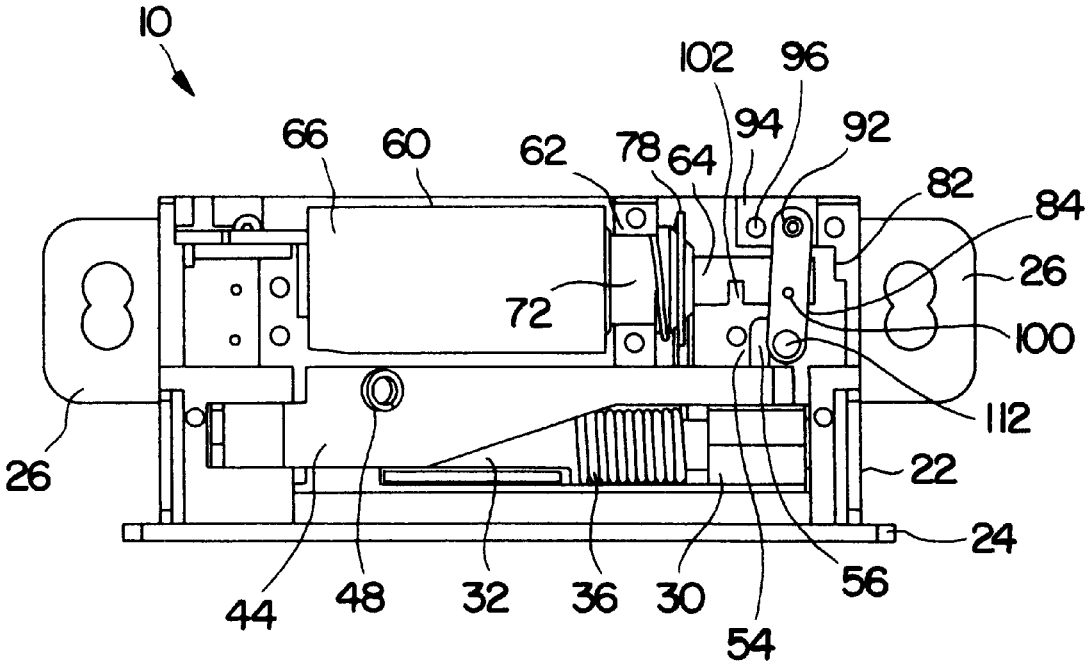
FIG. 5 is the electric strike view of FIG. 4 with the solenoid energized.

With reference to FIGS. 4, 5 and 18 which illustrate a fail safe configuration of the electric strike 10, the mount pivot pin 92 is positioned in the second mount opening 98 of the lock member mount 94. The plunger pivot pin 100 is further positioned in the second pivot notch 104 of the plunger 64. In the fail safe configuration, when the solenoid 60 is de-energized, the locking member 84 is maintained in a position wherein the lock engagement surface 106 of the engagement arm 88 is not engaged to the arm engagement surface 56 of the locking pin 54. Therefore, the keeper assembly 28 is unlocked when no electrical energy is applied to the solenoid 60 (see FIG. 4).

The electric strike 10 is maintained in a locked position by continual application of electrical energy to the solenoid 60 when the electric strike 10 is configured for fail safe operation. The solenoid 60 is continually energized to retract the plunger 64 and thereby overcome the biasing force of the solenoid spring 80. (See FIG. 5.) The locking member 84 is thereby pivoted to the locked position. In the locked position the lock engagement surface 106 of the engagement arm 88 is engaged to the arm engagement surface 56 of the locking pin 54 to lock the keeper assembly 28. (See FIG. 18.)

With reference to FIGS. 18 and 19, the arm engagement surface 56 and lock engagement surface are preferably contoured for efficient strike actuation under varying operational conditions. In particular, excessive friction between the engagement surfaces 56 can arise when a load is applied to the keeper and the strike is locked. Under this condition, excessive friction results in actuation of the lock failing to release the keeper until after load is moved. The engagement surfaces 56, 106 are therefore beveled for reduced friction under a loaded condition. Preferably, each engagement surface 56, 106 is bi-beveled in profile for engagement of beveled to beveled surface in both the fail safe and fail secure arrangements. The arm engagement surface 56 is double beveled and the lock engagement surface 106 is conical for engagement therewith.

The lock assembly 58 is readily reconfigurable between the fail safe configuration and the fail secure configuration. The upper housing cover 108 is removed from the strike frame 22 to begin the reconfiguration. The locking member 84, with the mount pivot pin 92 and plunger pivot pin 100, is transversely pulled out, and moved longitudinally and reinserted to reconfigure the electric strike 10. The mount pivot pin 92 and plunger pivot pin 100 thereby move between the first mounting opening 96 and first pivot notch 102, and the second mounting opening 98 and the second pivot notch 104. No additional components or specialized tools are preferably required in order to reconfigure the lock between being the fail safe configuration and fail secure configuration. The upper housing cover 108 is re-affixed to the strike frame 22 to complete the reconfiguration.

Figure 8:
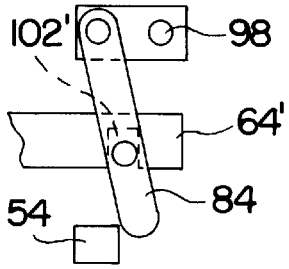
FIG. 8 is an enlarged fragmentary top view of a first alternative embodiment of the lock assembly for an electric strike in accordance with the invention wherein the lock assembly is in the fail safe configuration with the solenoid de-energized.
Figure 9:
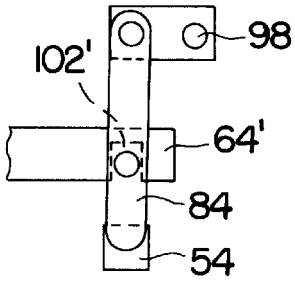
FIG. 9 is the lock assembly view of FIG. 8 in the fail safe configuration with the solenoid energized.
Figure 10:
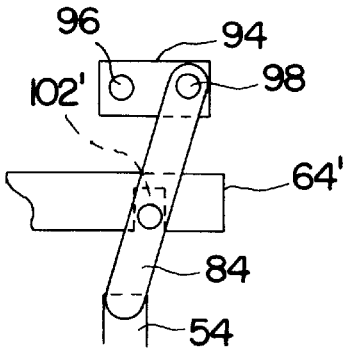
FIG. 10 is the lock assembly view of FIG. 8 in the fail secure configuration with the solenoid de-energized.
Figure 11:
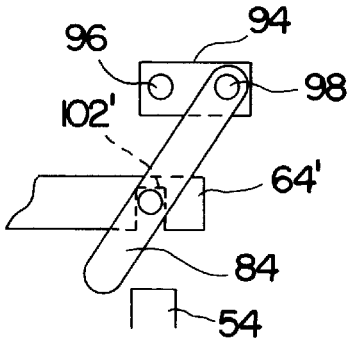
FIG. 11 is the lock assembly view of FIG. 10 in the fail secure configuration with the solenoid energized.

While the preferred embodiment of corresponding first and second mounting openings 96, 98 and first and second pivot notches 102, 104 is disclosed, it is readily recognizable that a reconfigurable lock assembly 58' can be accomplished by first and second mounting openings 96, 98 and a single pivot notch 102'. (See FIGS. 8–11.) With reference to FIG. 8, the mount pivot pin 92 is positioned in the first mount opening 96 and the plunger pivot pin is positioned in the pivot notch 102' in the fail safe arrangement. In the fail safe configuration, the lock engagement surface 106 of the locking member 84 is not engaged to the arm engagement surface of the locking pin 54. Therefore, the keeper assembly 28 is unlocked. The energization of the solenoid 60 results in retraction of the plunger 64' and positioning of the locking member 84 to lock the keeper assembly 28 by engagement of the locking member 84 and locking pin 54. (See FIG. 9.)

In the fail secure configuration, the mount pivot pin 92 is positioned in the second mount opening 98 and the plunger pin is again positioned in the pivot notch 102' of the plunger 64'. (See FIG. 10.) The locking member 84 is engaged to the locking pin 54 when the solenoid 60 is de-energized thereby locking the keeper assembly 28. Energization of the solenoid 60 pivots the locking member 84 whereby the locking member 84 and locking pin 54 are disengaged thereby unlocking the keeper assembly 28. (See FIG. 11.)

Figure 12:
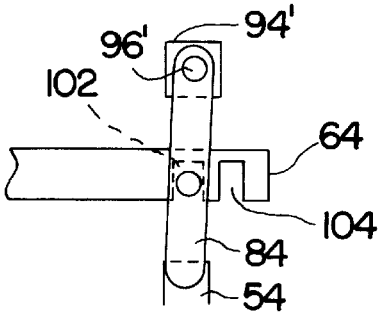
FIG. 12 is a partial enlarged view of a second alternative embodiment of the lock assembly in the fail secure configuration with the solenoid de-energized.
Figure 13:
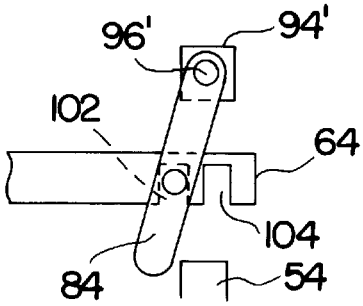
FIG. 13 is the lock assembly view of FIG. 12 with the solenoid energized.
Figure 14:
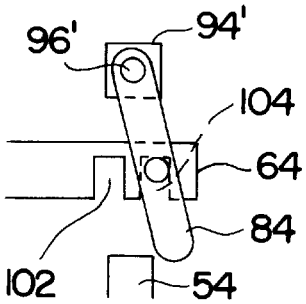
FIG. 14 is the lock assembly view of FIG. 12 in the fail safe configuration with the solenoid de-energized.
Figure 15:
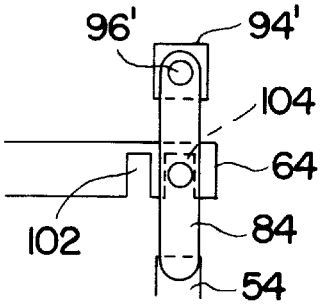
FIG. 15 is the lock assembly view of FIG. 14 with the solenoid energized.

In an alternate further embodiment of the invention, the locking assembly 58" comprises the plunger 64 having the first and second pivot notches 102, 104 and a single mount opening 96' on a locking member mount 94'. (See FIGS. 12–15.) In the fail secure configuration, the locking member 84 is pivotally mounted to the locking member mount 94' by the mount pivot pin 92 engaging the single mount opening 96'. (See FIG. 12.) The plunger pivot pin 100 is engaged to the first pivot notch 102 whereby the locking member 84 locks the keeper assembly 28 in the closed position. The energization of the solenoid 60 pivots the locking member 84 whereby the keeper assembly 28 is unlocked and can be opened. (See FIG. 13.)

In the fail safe configuration, the plunger pivot pin 100 is positioned to engage the second pivot notch 104 whereby the keeper assembly 28 is maintained in an unlocked condition. (See FIG. 14.) The energization of the solenoid 60 retracts the plunger 64 thereby pivoting the locking member 84 such that the keeper assembly 28 is locked in the closed position by engagement of the locking member 84 and the locking pin 54. (See FIG. 15.)

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. An electrically controlled strike for securing a door to a door frame comprising:

a strike frame defining a frame face opening and a jamb face opening;

a keeper assembly having a keeper pivotably mounted to said strike frame, said keeper having a closed position across said frame face opening and an opened position to open said frame face opening, a keeper spring for biasing said keeper to the closed position, said strike frame and said keeper defining a bolt receiving cavity;

a lock assembly engaging said keeper assembly for selectively locking said keeper in said closed position, said lock assembly comprising;

an actuator assembly having a plunger, said plunger having a first plunger position and a second plunger position, a said plunger biased to one said plunger position, said actuator assembly moving said plunger to said other plunger position when energized;

a locking mount fixed to the strike frame;

a locking member defining a locking surface engageable with said keeper assembly to lock said keeper in said closed position, said locking member pivotably engageable to said locking mount and said plunger in a fail safe configuration wherein said locking surface engages said keeper assembly to lock the keeper in the closed position when the plunger is in said second plunger position and to release said keeper assembly wherein said keeper can pivot to the opened position when said plunger is in said first plunger position, said locking member pivotably engageable to said locking mount and said plunger in a fail secure configuration wherein said locking surface engages said keeper assembly to lock said keeper in the closed position when said plunger is in said first plunger position and to release said keeper assembly wherein said keeper can pivot to the opened position when said plunger is in said second plunger position, said locking member including a first end portion and an opposite second end portion, a first coupler mounted to said first end portion for said pivotable engagement with said locking mount, said second end portion defining said locking surface, said plunger resides between said first coupler and said locking surface and a second coupler positioned between said first coupler and said locking surface which engages with said plunger.

2. The electrically controlled strike of claim 1 wherein said first coupler comprises a pivot pin, and said second coupler comprises a second pivot pin.

3. The electrically controlled strike of claim 2 wherein said first pivot pin defines a first pivot axis, said second pivot pin defines a second pivot axis, said first pivot axis being parallel to said second pivot axis.

4. The electrically controlled strike of claim 1 wherein said keeper assembly further comprises a retaining arm engaging said keeper, said retaining arm having a first arm position and a second arm position, said keeper moving said retaining arm from said first arm position to said second arm position when said keeper moves from said closed position to said opened position, said retaining arm locking said keeper in said closed position when said retaining arm is locked in said first position, said retaining arm further defining an arm engagement surface engageable to said locking surface of said locking member to lock said keeper in the closed position.

5. The electrically controlled strike of claim 4 wherein said locking surface and said arm engagement surface are each bi-beveled in profile.

6. The electrically controlled strike of claim 4, wherein said retaining arm comprises an arm end portion including a generally orthogonal projection, said projection defining said retaining arm engagement surface.

7. The electrically controlled strike of claim 1 further comprising a strike cover and indicator means for indicating said fail safe and fail secure configuration through said cover.

8. The electrically controlled strike of claim 7 wherein said cover defines a plurality of indicator openings, and said indicator means comprises a first pivot defining an end portion extendable through said indicator openings.

9. The electrically controlled strike of claim 7, wherein said cover defines a plurality of indicator openings, and said indicator means comprises a first pivot defining an end portion pivotable within each of said indicator openings.

10. An electrically controlled strike for securing a door to a door frame comprising:

a strike frame defining a frame face opening and a jamb face opening;

a keeper assembly comprising a keeper pivotably mounted to said strike frame, said keeper having a closed position a cross said frame face opening and an opened position to open said frame face opening, said keeper assembly further comprising a pivotable retaining arm engageable with said keeper, said retaining arm having a first arm position when said keeper is in said closed position and a second arm position when said keeper is in said opened position, said keeper pivoting said retaining arm between said first arm position and said second arm position when said keeper pivots between said closed position and said opened position, and said retaining arm locking said keeper in said closed position when said retaining arm is locked in said first arm position, said strike frame and said keeper defining a bolt receiving cavity;

a lock assembly for selectively locking said keeper in said closed position, said lock assembly comprising, an actuator assembly comprising a solenoid plunger defining first and second spaced engagement member receivers and said plunger having a first plunger position and a second plunger position, an actuator spring for biasing said plunger to said first plunger position, and a solenoid coil for moving said plunger from said first plunger position to said second plunger position when energized;

a locking member mount fixed to the strike frame and having first and second spaced apart pivot mounts for receiving a lock pivot;

a locking member for locking said retaining arm in said first arm position, said locking member having a lock pivot and a plunger engagement member, said locking member engageable with said plunger and said locking member mount in a fail safe arrangement wherein said lock pivot is engaged with said first pivot mount and said plunger engagement member is engaged with said first engagement member receiver to lock said retaining arm in said first arm position when said solenoid is in said second plunger position and release said retaining arm to be movable to said second arm position when said plunger is in said first plunger position, said locking member further engageable with said plunger and said locking member mount in a fail secure arrangement wherein said lock pivot is engaged with said second pivot mount and said plunger engagement member is engaged with said second engagement member receiver to lock said retaining arm in said first arm position when said solenoid is in said first plunger position and release said retaining arm to be movable to said second arm position when said plunger is in said second plunger position.

11. The electrically controlled strike of claim 10 wherein said retaining arm has a first arm end portion and an opposite second arm end portion, said first arm end portion pivotably mounted to said strike frame and said locking member engaging said second arm end portion.

12. The electrically controlled strike of claim 10 wherein said lock pivot defines a pivot axis and said plunger engagement member defines an engagement member pivot axis, said pivot axis and said engagement member pivot axis being generally parallel.

13. The electrically controlled strike of claim 10 wherein said locking member has a first end portion and a second end portion, a first coupler mounted to said first end portion for said pivotable engagement with said locking member mount, said second end portion defining a locking surface, and a second coupler positioned between said first coupler and said locking surface for engagement with said plunger.

14. The electrically controlled strike of claim 13 wherein said first coupler comprises a pivot pin, and said second coupler comprises a second pivot pin.

15. The electrically controlled strike of claim 10 wherein said retaining arm further defines an arm engagement surface engageable to said locking surface of said locking member to lock said keeper in the closed position.

16. The electrically controlled strike of claim 15 wherein said locking surface and said arm engagement surface are each bi-beveled in profile.

17. The electrically controlled strike of claim 10 further comprising a strike cover and indicator means for indicating said fail safe and fail secure configuration through said cover.

18. The electrically controlled strike of claim 17 wherein said cover defines a plurality of indicator openings, and said indicator means comprises a first pivot defining an end portion extendable through said indicator openings.

* * * * *